US006575317B2

(12) United States Patent
Taylor

(10) Patent No.: US 6,575,317 B2
(45) Date of Patent: Jun. 10, 2003

(54) PENDANT-RESPONSIVE CRANE CONTROL

(75) Inventor: Michael K. Taylor, Marion, NY (US)

(73) Assignee: Gorbel, Inc., Fishers, NY (US)

( * ) Notice: Subject to any disclaimer, the term of this patent is extended or adjusted under 35 U.S.C. 154(b) by 0 days.

(21) Appl. No.: 09/978,897

(22) Filed: Oct. 16, 2001

(65) Prior Publication Data

US 2002/0066711 A1 Jun. 6, 2002

Related U.S. Application Data

(60) Provisional application No. 60/241,318, filed on Oct. 18, 2000.

(51) Int. Cl.[7] ..... B66C 13/44

(52) U.S. Cl. ..... 212/285; 212/270; 212/328; 212/331

(58) Field of Search ..... 212/275, 285, 212/270, 328, 331

(56) References Cited

U.S. PATENT DOCUMENTS 2,940,608 A * 6/1960 Underwood et al. ..... 212/124
3,781,493 A * 12/1973 Darmon ..... 200/18
5,350,075 A 9/1994 Kahlman ..... 212/159
5,850,928 A 12/1998 Kahlman et al. ..... 212/285
6,204,619 B1 * 3/2001 Gu et al. ..... 318/568.11

FOREIGN PATENT DOCUMENTS

JP 2018293 1/1990

* cited by examiner

*Primary Examiner*—Thomas J. Brahan
(74) *Attorney, Agent, or Firm*—Eugene Stephens & Associates; Steven R. Scott

(57) ABSTRACT

This pendant responsive crane control system has a sensor pendulum arranged above a hoist for the crane and a load sensor for determining the load lifted by the hoist. The sensor pendulum serves as a swinging link between the hoist and a crane drive for moving the hoist. Lateral movement sensors generate signals in response to lateral movement of the sensor pendulum. A crane control means directs lateral movement of the crane drive in response to the signals generated by these sensors. The load sensor used is preferably a load cell or strain gauge incorporated into the sensor pendulum.

18 Claims, 2 Drawing Sheets

PENDANT-RESPONSIVE CRANE CONTROL

This application claims the benefit of U.S. Provisional Application No. 60/241,318, filed on Oct. 18, 2000, which provisional application is incorporated by reference herein,

TECHNICAL FIELD

Overhead and jib cranes that can be driven to move a lifted load in a horizontal direction.

BACKGROUND

Suggestions have been made for power-driven cranes to move a hoisted load laterally in response to manual effort applied by a worker pushing on the lifted load. A sensing system determines from manual force input by a worker the direction and extent that the load is desired to be moved, and the crane responds to this by driving responsively to move the lifted load to the desired position. Examples of such suggestions include U.S. Pat. Nos. 5,350,075 and 5,850,928 and Japanese Patent JP2018293.

A problem encountered by such systems is a pendulum effect of the lifted load swinging back and forth. For example, as the crane starts moving in a desired direction, the mass of the load momentarily lags behind and then swings toward the desired direction. A sensing system included in the crane can misinterpret such pendulum swings for worker input force. This can result in the crane driving in one direction, establishing a pendulum swing, sensing that as a reverse direction indicator, and driving in the opposite direction, causing a dithering motion. In effect, by misinterpreting pendulum swings as worker input force, the crane can misdirect the load in various ways that are not efficient or ergonomically satisfactory.

SUMMARY OF THE INVENTION

The inventive solution involves a sensing pendulum arranged above a hoist for the crane and a sensor for determining the load lifted by the hoist. The load sensor is preferably a load cell or strain gauge incorporated into the sensor pendulum. Arranging a sensor pendulum above the hoist provides some beneficial mechanical damping of pendulum effects from the hoist swinging below the sensing pendulum and the cable or rope and load swinging below the hoist. Two pendulum links below the sensing pendulum, including the hoist and load, divide or distribute pendulum effects and make them less evident to motion sensors arranged above the hoist to respond to the sensing pendulum. Crane control software receiving lateral load movement information from X and Y sensors arranged above the hoist, along with information on the mass of any load suspended from the hoist, can better distinguish between worker input force and consequential movement of the pendulum links below the sensor pendulum.

The invention thus involves arranging a sensor pendulum and associated X and Y sensors above a crane hoist while also sensing the mass of any load suspended from the hoist. Such a mechanical arrangement of motion and load sensors enables a crane control system to derive more reliable information on worker input force to the load and more reliably drive the crane in a desired direction to move a hoisted load to a position indicated by a worker. Preparing suitable software for driving the crane in response to worker input is made easier by suspending the hoist from a sensing pendulum that senses load mass and supplying load motion signals to crane control software from sensors detecting movement of the pendulum above the hoist.

DRAWINGS

DETAILED DESCRIPTION

Figure 1:
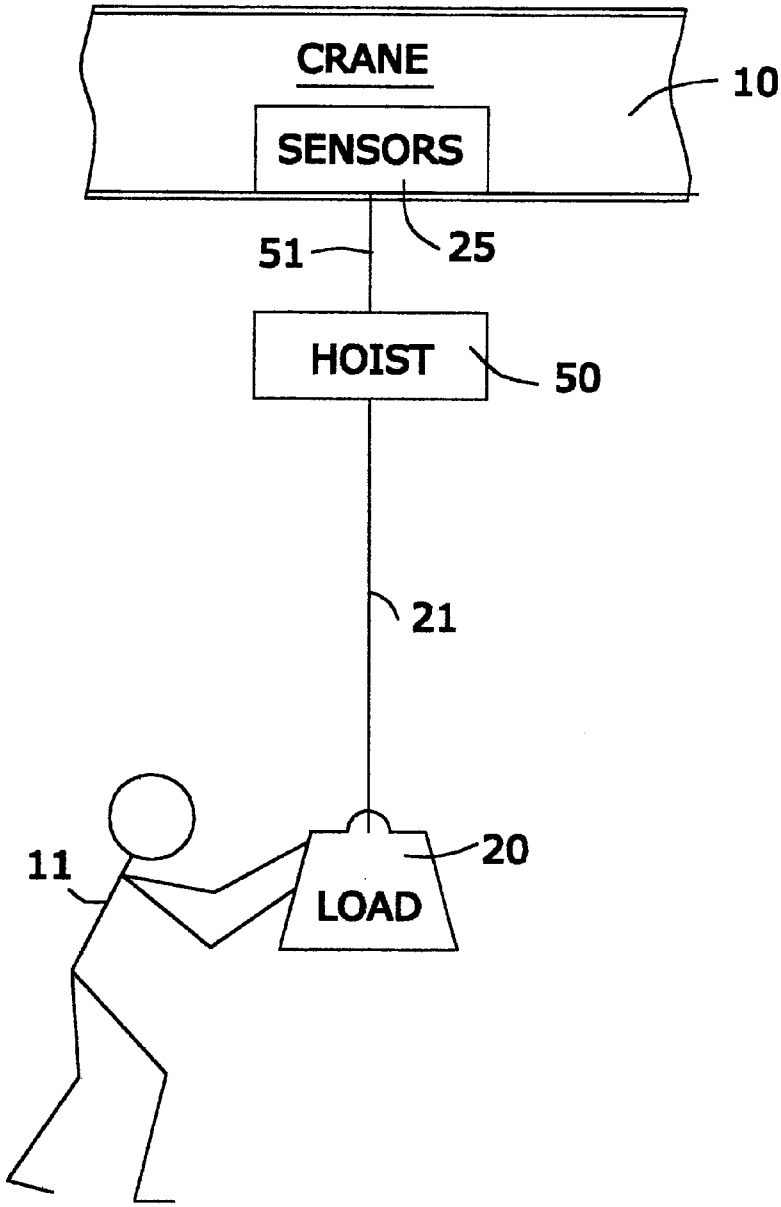
FIG. 1 is a schematic view illustrating pendant crane control sensors arranged above a hoist supporting a lifted load and pushed toward a destination by a worker.

FIG. 1 illustrates that sensors 25 for pendant crane 10 are arranged above hoist 50 supporting a lifted load 20. A worker 11 pushing on load 20 as illustrated can urge load 20 in a desired direction of movement. Sensors 25 are arranged to sense force input to load 20 by worker 11 who indicates by the input force a desired direction of lateral movement for load 20. Crane 10 then responds to input force by worker 11 to drive sensors 25 and hoist 50 to the desired location for lowering load 20.

Since load 20 is supported on cable or rope 21 suspended from hoist 50, load 20 and rope 21 can act as a pendulum swinging below hoist 50. Hoist 50, which is suspended from crane 10 by connector 51, can also have a pendulum effect resulting in hoist 50 swinging below crane 10 in response to lateral movement of load 20. Hoist 50 and its suspension 51 thus constitute one link in a two-link pendulum, the other link of which involves rope 21 and load 20. As drive system 45 of crane 10 moves load 20 horizontally in response to force input from worker 11, pendulum effects of load 20 and hoist 50 can occur in addition to desired-direction-of-movement-force input by worker 11.

Figure 2:
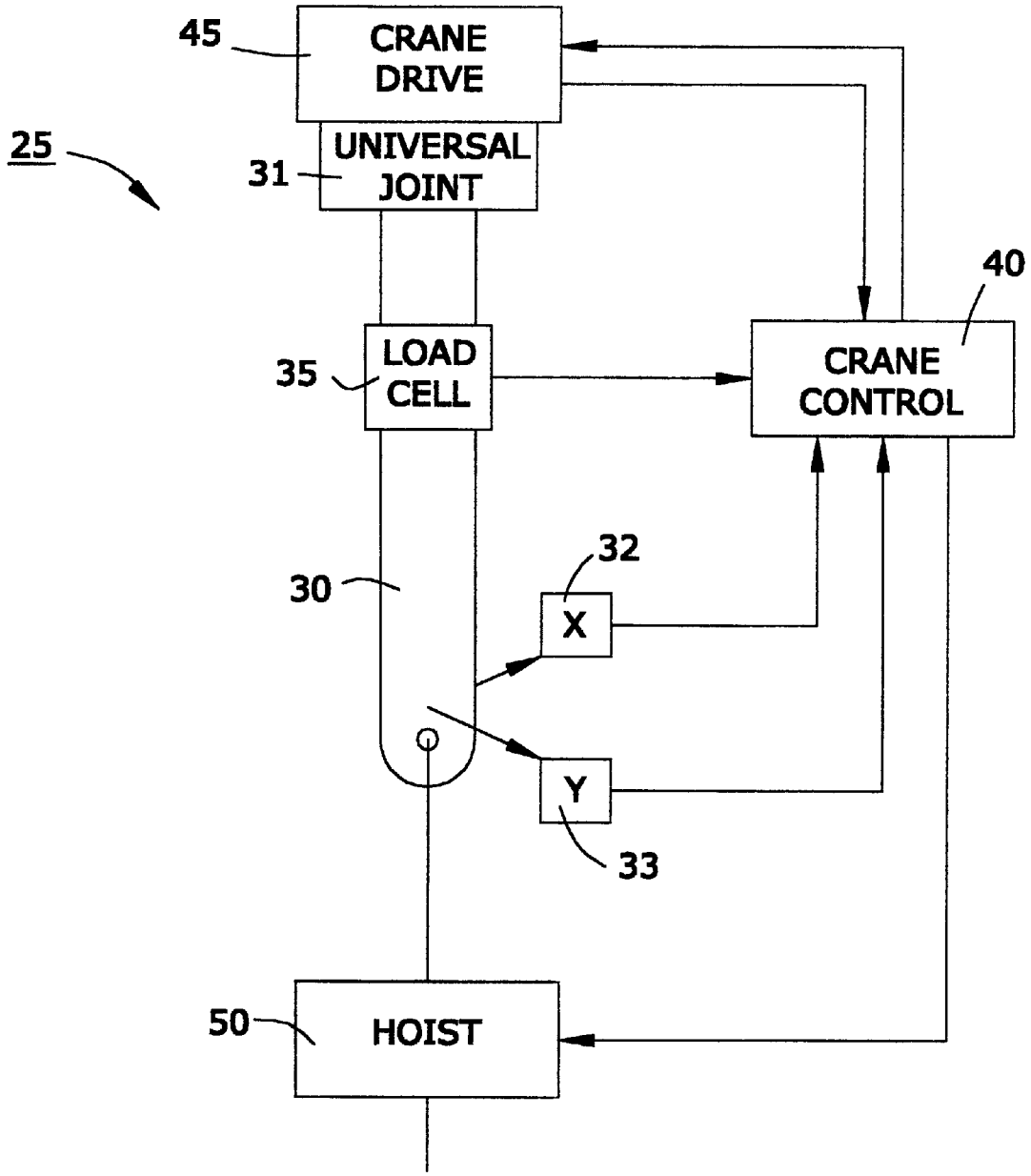
FIG. 2 is a schematic diagram of a sensing pendulum arranged above a hoist and interconnected with a control system for driving a crane to a position indicated by worker input.

Sensors 25, as best shown in FIG. 2, are arranged above hoist 50 where they are less subject to pendulum effects of load 20 and hoist 50. Sensors 25, in the preferred location above hoist 50, can effectively detect worker input force distinguished from pendulum effects of hoist 50 and load 20 to supply crane control 40 with information necessary to operate crane drive 45 and move lifted load 20 to the position desired by worker 11.

A principal element of sensors 25 is sensing pendulum 30 suspended by a universal joint 31 from crane drive 45, which is typically a hoist trolley that is driven in response to crane control 40. Universal joint 31 can be any of a variety of devices that allow pendulum 30 to swing in any direction in a lateral x-y plane, as illustrated. Universal joint 31 can thus be a ball joint, hook and ring joint, double clevises perpendicular to each other, etc. Preferably, joint 31 is compact, involves low friction, and enables pendulum 30 to swing responsively within the x-y plane.

An x sensor 32 and a y sensor 33 are near a lower region of pendulum 30 where sensors 32 and 33 are arranged perpendicular to each other to respectively sense x and y direction swing movements of pendulum 30. Sensors 32 and 33 can have a variety of forms including mechanical, electromechanical, and optical; and preferences among these forms include linear encoders, optical encoders, and electrical devices responsive to small movements. Sensors 32 and 33 preferably sense magnitude as well as direction of swinging movement of sensing pendulum 30, and sensors 32 and 33 are connected with crane control 40 to supply both amplitude and directional information on movement sensed by pendulum 30.

For pendant crane 10 to be successful in determining the force input of worker 11 and moving load 20 to a desired position, it is important for crane control 40 to receive information indicating the mass of any load 20 involved in the movement. The force or mass of load 20 is preferably sensed by a load cell or strain gauge 35 incorporated into sensing pendulum 30, but other possibilities can also be used. A load sensor incorporated into or suspended below hoist 50, for example. There are advantages, though, in including load sensor 35 in a compact package including directional force sensors 32 and 33 arranged above hoist 50. If lifting height constraints are a problem for a particular pendant crane, it is possible to arrange sensors 25 between a pair of bridge beams separated by enough space to receive sensors 25 so that hoist 50 can be suspended directly below the pair of bridge beams at the same elevation that it would have had if suspended from a singe bridge beam.

In operation, once load 20 is lifted by hoist 50, worker 11 pushes against load 20 to indicate a desired direction of movement. Deflection of load 20 and rope 21 will depend on the force of directional input from worker 11 and by the mass of load 20. This will cause some movement of load 20 and rope 21 and some smaller movement of hoist 50. It will also cause movement of sensing pendulum 30 above hoist 50, and this movement will be sensed by detectors 32 and 33 for both amplitude and direction. The detected lateral movement of pendulum 30 is fed to crane control 40, along with information on the mass of load 20, as sensed by load sensor cell 35. With these inputs, control software within crane control 40 sends information to crane drive 45, which moves a crane trolley or bridge in the direction indicated by the worker.

Starting crane 10 in motion can cause pendulum effects in load 20 and hoist 50 in response to crane movement. It is important for crane control 40 not to respond erroneously to such pendulum effects from crane movement and to respond only to movement effects from input of worker 11. Arranging sensors 25 above hoist 50 helps in making this distinction. Software in crane control 40, when provided by signals from sensors 32, 33, and 35 arranged above hoist 50 can more reliably distinguish directional force input of worker 11 from responsive swings of the two-link pendulum formed of hoist 50 and load 20. Experience has shown that making this distinction by sensing pendulum movements of load 20 or hoist 50 is daunting compared to making the same distinctions by using sensing pendulum 30 arranged above hoist 50.

I claim:

1. A pendant responsive crane control system, comprising:

a swinging link between a rotary hoist for lifting a load and a crane drive for moving said hoist;

lateral movement sensors that generate signals in response to lateral movement of said swinging link; and crane control means directing lateral movement of said crane drive in response to the signals generated by said sensors.

2. A pendant responsive crane control system as set forth in claim 1, wherein said swinging link depends from said crane drive.

3. A pendant responsive crane control system as set forth in claim 1, wherein said swinging link depends from said crane drive by a universal joint.

4. A pendant responsive crane control system as set forth in claim 1, wherein said sensors generate signals indicating direction of lateral movement.

5. A pendant responsive crane control system as set forth in claim 1, wherein said sensors generate signals indicating the direction and magnitude of lateral movement.

6. A pendant responsive crane control system comprising:

a swinging link between a hoist for lifting a load and a crane drive for moving said hoist;

lateral movement sensors that generate signals in response to lateral movement of said swinging link;

crane control means directing lateral movement of said crane drive in response to the signals generated by said sensors; and a load sensor that generates load signals in response to the load thereon.

7. A pendant responsive crane control system as set forth in claim 6, wherein said load sensor is located above said hoist.

8. A pendant responsive crane control system as described in claim 7, wherein said swinging link includes said load sensor.

9. A pendant responsive crane control system as set forth in claim 8, wherein said load sensor is a load cell.

10. A method for controlling a pendant responsive crane system, comprising:

generating lateral movement signals via lateral movement sensors responsive to lateral movement of a swinging link positioned between a rotary hoist for lifting a load and a crane drive for moving said hoist; and directing lateral movement of said crane drive via a crane control means responsive to the signals generated by said sensors.

11. A method for controlling a pendant responsive crane system as set forth in claim 10, said first step further comprising generating load signals via load sensors.

12. A pendant responsive crane control system, comprising:

a swinging link between a hoist for lifting a load and a crane drive for moving said hoist;

lateral movement sensors that generate signals in response to lateral movement of said swinging link indicating the direction and magnitude of said lateral movement;

a load sensor generating load signals in response to the load thereon; and crane control means directing lateral movement of said crane drive in response to the signals generated by said sensors.

13. A pendant responsive crane control system as set forth in claim 12, wherein said swinging link depends from said crane drive by a universal joint.

14. A pendant responsive crane control system as set forth in claim 12, wherein said load sensor is located above said hoist.

15. A pendant responsive crane control system as described in claim 12, wherein said swinging link includes said load sensor.

16. A pendant responsive crane control system as set forth in claim 12, wherein said load sensor is a load cell.

17. A pendant responsive crane control system, comprising:

a swinging link between a flexible line hoist for lifting a load suspended from said hoist by a flexible line and a crane drive for moving said hoist;

lateral movement sensors that generate signals in response to lateral movement of said swinging link; and crane control means directing lateral movement of said crane drive in response to the signals generated by said sensors.

18. A pendant responsive crane control system, comprising:

a swinging link and a flexible line between a hoist for lifting a load suspended from said hoist and a crane drive for moving said hoist;

lateral movement sensors that generate signals in response to lateral movement of said swinging link; and crane control means directing lateral movement of said crane drive in response to the signals generated by said sensors.

* * * * *